US011193303B2

(12) United States Patent
Morstatt

(10) Patent No.: US 11,193,303 B2
(45) Date of Patent: Dec. 7, 2021

(54) DOOR LOCK AND HANDLE ASSEMBLY

(71) Applicant: ASSA ABLOY Residential Group, Inc., New Haven, CT (US)

(72) Inventor: Scott Morstatt, Maryville, TN (US)

(73) Assignee: ASSA ABLOY Residential Group, Inc., New Haven, CT (US)

( * ) Notice: Subject to any disclaimer, the term of this patent is extended or adjusted under 35 U.S.C. 154(b) by 808 days.

(21) Appl. No.: 15/926,566

(22) Filed: Mar. 20, 2018

(65) Prior Publication Data

US 2018/0283044 A1 Oct. 4, 2018

Related U.S. Application Data

(60) Provisional application No. 62/479,739, filed on Mar. 31, 2017.

(51) Int. Cl.
*E05B 3/00* (2006.01)
*E05B 3/02* (2006.01)
(Continued)

(52) U.S. Cl.
CPC ..... *E05B 3/02* (2013.01); *E05B 3/003* (2013.01); *E05B 3/04* (2013.01); *E05B 71/00* (2013.01);
(Continued)

(58) Field of Classification Search
CPC . Y10T 292/82; Y10T 292/85; Y10T 292/869; Y10T 292/65; Y10T 292/67;
(Continued)

(56) References Cited

U.S. PATENT DOCUMENTS 283,380 A * 8/1883 Cooper ..... E05B 1/0007 292/347
349,483 A * 9/1886 Day ..... E05B 3/003 292/352
(Continued)

FOREIGN PATENT DOCUMENTS

DE 631711 C * 6/1936 ..... E05B 3/02
DE 3105217 A1 * 9/1982 ..... E05B 3/02
(Continued)

OTHER PUBLICATIONS

Invitation to Pay Additional Fees for International Application No. PCT/US2018/025356, dated Jun. 14, 2018.
(Continued)

*Primary Examiner* — Carlos Lugo
(74) *Attorney, Agent, or Firm* — Wolf, Greenfield & Sacks, P.C.

(57) ABSTRACT

A door handle assembly that allows for easy removal and switching of handles. Such an arrangement may provide the flexibility to change handle orientation and interchange handles based on a user's circumstances or preferences such as when a door handle is configured as a lever having a curved shape. Further, the door handle may be configured as a door lock having a keypad access control. The face of the keypad accessible from outside the door may include auxiliary battery terminals to provide the user with easy accessibility for providing temporary power to the door lock with an auxiliary battery should the installed batteries housed within the door lock fail to provide sufficient power.

22 Claims, 6 Drawing Sheets

(51) Int. Cl.

| | |
|---|---|
| ***E05B 71/00*** | (2006.01) |
| ***E05B 3/04*** | (2006.01) |
| *E05B 47/00* | (2006.01) |
| *E05B 37/00* | (2006.01) |
| *E05B 1/00* | (2006.01) |

(52) U.S. Cl.
CPC ..... *E05B 1/003* (2013.01); *E05B 37/00* (2013.01); *E05B 47/00* (2013.01); *E05B 2047/0057* (2013.01); *E05B 2047/0058* (2013.01); *Y10T 292/85* (2015.04); *Y10T 292/869* (2015.04)

(58) Field of Classification Search
CPC ..... Y10T 292/0969; Y10T 292/097; Y10T 292/0997; E05B 3/02; E05B 3/003; E05B 3/04
See application file for complete search history.

(56) References Cited

U.S. PATENT DOCUMENTS 490,685 A * 1/1893 Schilling ..... E05B 3/003 292/352
768,952 A * 8/1904 Roberts ..... E05B 3/04 292/353
1,621,174 A * 3/1927 Schlage ..... E05B 3/003 292/353
1,958,165 A * 5/1934 Le Compte ..... F16K 31/60 16/425
2,660,466 A * 11/1953 Cerf, Jr. ..... E05B 3/003 292/352
2,739,006 A * 3/1956 Fisler ..... E05B 3/003 292/352
2,739,472 A 3/1956 North et al.
2,778,667 A * 1/1957 Young ..... E05B 3/003 292/352
2,850,313 A * 9/1958 Check ..... G05G 1/12 292/352
3,177,024 A * 4/1965 Krook ..... E05B 3/003 292/353
3,695,664 A * 10/1972 Nolin ..... E05B 3/003 292/352
4,342,478 A * 8/1982 Foshee ..... E05B 55/005 292/352
4,428,570 A * 1/1984 Foshee ..... E05B 3/003 267/159
4,431,331 A * 2/1984 Brody ..... F16B 7/0446 403/189
4,639,026 A * 1/1987 Smallegan ..... E05B 3/003 292/169.23
4,765,163 A 8/1988 Trull et al.
4,971,374 A * 11/1990 Lovell ..... E05C 21/00 206/231
5,352,057 A * 10/1994 Zody ..... F16B 7/105 403/109.3
5,388,307 A * 2/1995 Hyde ..... G05G 1/12 16/441
5,787,548 A * 8/1998 Tzen ..... A01G 17/10 16/82
5,947,537 A * 9/1999 Aigner ..... E05B 3/003 292/348
6,145,353 A 11/2000 Doucet
6,695,365 B2 * 2/2004 Chong ..... E05B 3/00 292/347
7,143,477 B2 * 12/2006 Dalsing ..... E05B 3/003 16/412
7,281,738 B2 * 10/2007 Shen ..... E05B 3/00 292/348
7,475,925 B2 * 1/2009 Huang ..... E05B 15/02 292/347
8,201,307 B2 6/2012 Romero
2002/0105195 A1 8/2002 Adelmeyer
2007/0051144 A1 * 3/2007 Huang ..... E05B 3/003 70/224
2009/0001735 A1 * 1/2009 Neumayer ..... E05B 1/0015 292/350
2009/0193859 A1 8/2009 Kwon et al.
2014/0196566 A1 * 7/2014 Hsieh ..... E05B 3/003 74/548

FOREIGN PATENT DOCUMENTS

DE 29718871 U1 * 2/1998 ..... E05B 3/04
EP 1 178 167 A1 2/2002
GB 577760 A * 5/1946 ..... E05B 3/04
GB 2013271 A * 8/1979 ..... E05B 3/003

OTHER PUBLICATIONS

International Search Report and Written Opinion for International Application No. PCT/US2018/025356, dated Aug. 8, 2018.
International Preliminary Report on Patentability for International Application No. PCT/US2018/025356, dated Oct. 10, 2019.

* cited by examiner

DOOR LOCK AND HANDLE ASSEMBLY

RELATED APPLICATION

This application claims the benefit under 35 U.S.C. § 119(e) to U.S. Provisional Application No. 62/479,739, filed on Mar. 31, 2017, which is incorporated herein in its entirety.

FIELD

The disclosed embodiments relate generally to door locks and more particularly to an electronic door lock and a door handle assembly with interchangeable handle levers.

BACKGROUND

Door locks can include a physical key or a keypad to unlock the door. Locks with keypads can either be mechanical or electronic. Upon entry of a predetermined code, the keypad sends an electrical signal to the lock that unlocks the lock. Electronic keypads obviously require electrical power, which is oftentimes provided by means of a battery. Some electronic keypad locks will provide the user with an indication when the battery is running low so that it may be changed in time before the keypad is completely out of power and therefore unable to unlock the lock.

Some door locks, even those with an electronic keypad, include a handle such as a knob or a lever to allow the user to physically retract the door latch from the door frame to thereby allow the door to hinge open. The door lock may be mounted to either the left side of the door or the right side of the door, with the lever extending in a direction generally away from the door latch and toward the hinge side of the door. Some levers are curved or otherwise have a directionality or asymmetry.

SUMMARY

In one embodiment, a door handle is provided for a door having a first side and a second side. The door handle comprises a first body portion for mounting to the first side of the door and a second body portion for mounting to the second side of the door. The first body portion includes a first sleeve extending therefrom, and the second body portion includes a second sleeve extending therefrom. The door handle further comprises a first handle configured to be interchangeably coupled to each of the first sleeve and the second sleeve, and a second handle configured to be interchangeably coupled to each of the first sleeve and the second sleeve. The first sleeve includes a first handle interlock constructed and arranged to releasably couple each of the first handle and the second handle to the first sleeve and the second sleeve includes a second handle interlock constructed and arranged to releasably couple each of the first handle and the second handle to the second sleeve. The first handle is selectively mountable to one of the first sleeve and the second sleeve to be positioned on one of the first side and the second side of the door, and the second handle is selectively mountable to the other of the first sleeve and the second sleeve to be positioned on the other of the first side and second side of the door.

In another embodiment, a handle assembly is provided for a door lock. The handle assembly comprises a sleeve configured to mount a handle to the door lock, the sleeve including first and second openings extending through an outer surface thereof, first and second spring-biased pins inserted in the first and second openings of the sleeve, and a handle including a tubular base and an actuatable portion extending from the base to be manipulated to actuate the door lock. A portion of each of the first and second pins extends external to the outer surface of the sleeve when the first and second pins are biased outwardly to a locking position. The base of the handle is configured to be coupled to the sleeve, and has an opening configured to receive one of the first and second pins to secure the handle to the sleeve.

In still another embodiment, an electronic door lock comprises a door lock housing, an electronic circuit housed in the door lock housing, and auxiliary battery terminals located on a front face of the door lock housing. The electronic circuit is configured to receive power from at least one battery housed in the door lock housing, and is operable to unlock the door lock in response to receiving an access code from a user. The auxiliary battery terminals are operatively coupled to the electronic circuit to provide temporary power to the electronic circuit when power is not available from the at least one battery.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
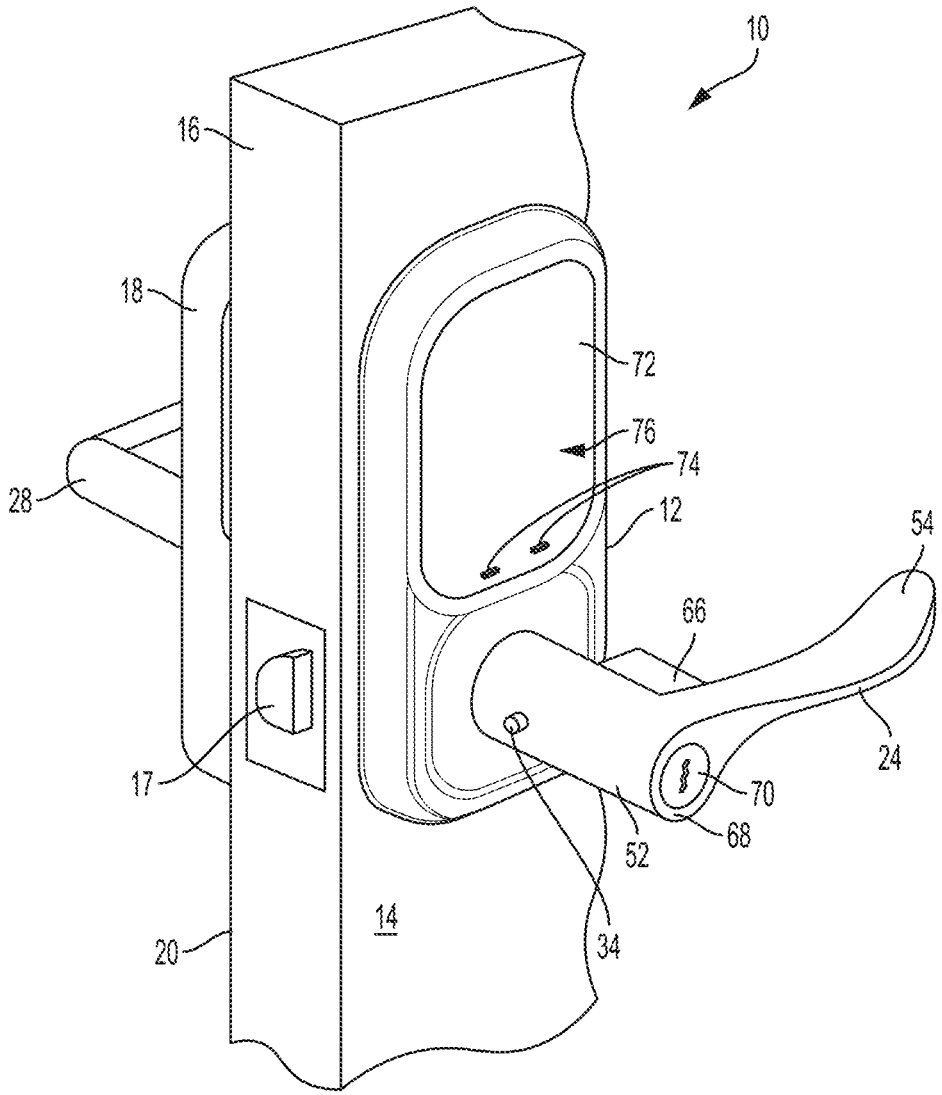
FIG. 1 is a right front perspective view of a door handle assembly according to one embodiment.

The inventors have recognized and appreciated the drawbacks associated with conventional door locks that include an electronic keypad. If the battery is unable to provide sufficient power, such as die, the keypad would become inoperable, preventing access through the doorway. Some door locks with electronic keypads include an auxiliary set of battery terminals that are accessible from outside the door. In this way, a user can simply attach an appropriate battery from the outside to provide temporary power to the electronic door lock. Unfortunately, the auxiliary exterior battery terminals may be difficult to access especially when the door lock includes a door handle arrangement located beneath the keypad. Accordingly, the inventors have recognized that locating the auxiliary battery terminals on the face of the keypad will provide the user with greater access to connect a temporary battery. In this respect, a conventional 9V battery may be placed against the terminals at generally a 90 degree direction relative to the face of the keypad.

The inventors have also recognized and appreciated the drawbacks associated with conventional door handles that have asymmetric handles, such as asymmetric levers. The inventors have recognized that depending on the side of the door (i.e., the right side of the door or the left side of the door when viewing the door from one side) to which the door handle will be mounted, the handles may need to be swapped. For example, when viewing the door from the one side of the door (e.g., outside), when the door handle assembly is to be mounted on the left side of the door, the outside lever is mounted to the outside portion of the door handle assembly. However, when that same door handle assembly is to be mounted on the right side of the door, the outside lever now must be mounted on the opposite side of the door (e.g., inside) and the inside lever is to be mounted on the outside. Such a scenario can occur when employing levers that are not identical to each other—for example, when the handles are asymmetric such that they are mirror images of each other, such as may be the case where a lever has a curved shape. It should be appreciated that although some embodiments are discussed herein as relating to door locks (e.g., keyed or keypad (electronic or manual) door locks), the disclosure is not so limited and the inventive concepts may be employed on door handle assemblies where no lock is employed (e.g., passage or dummy handles). Accordingly, the term door handle or door assemblies refers to any of the foregoing arrangements.

Furthermore, conventional door handle assemblies may require partial disassembly that may involve many steps, tools, and parts that may be misplaced when changing the handle/lever.

In view of the above, the inventors have recognized the advantages associated with a door handle assembly that allows for easy removal and switching of handles. Such an arrangement may provide the flexibility to change handle orientation and interchange handles based on a user's circumstances or preferences.

Figure 2:
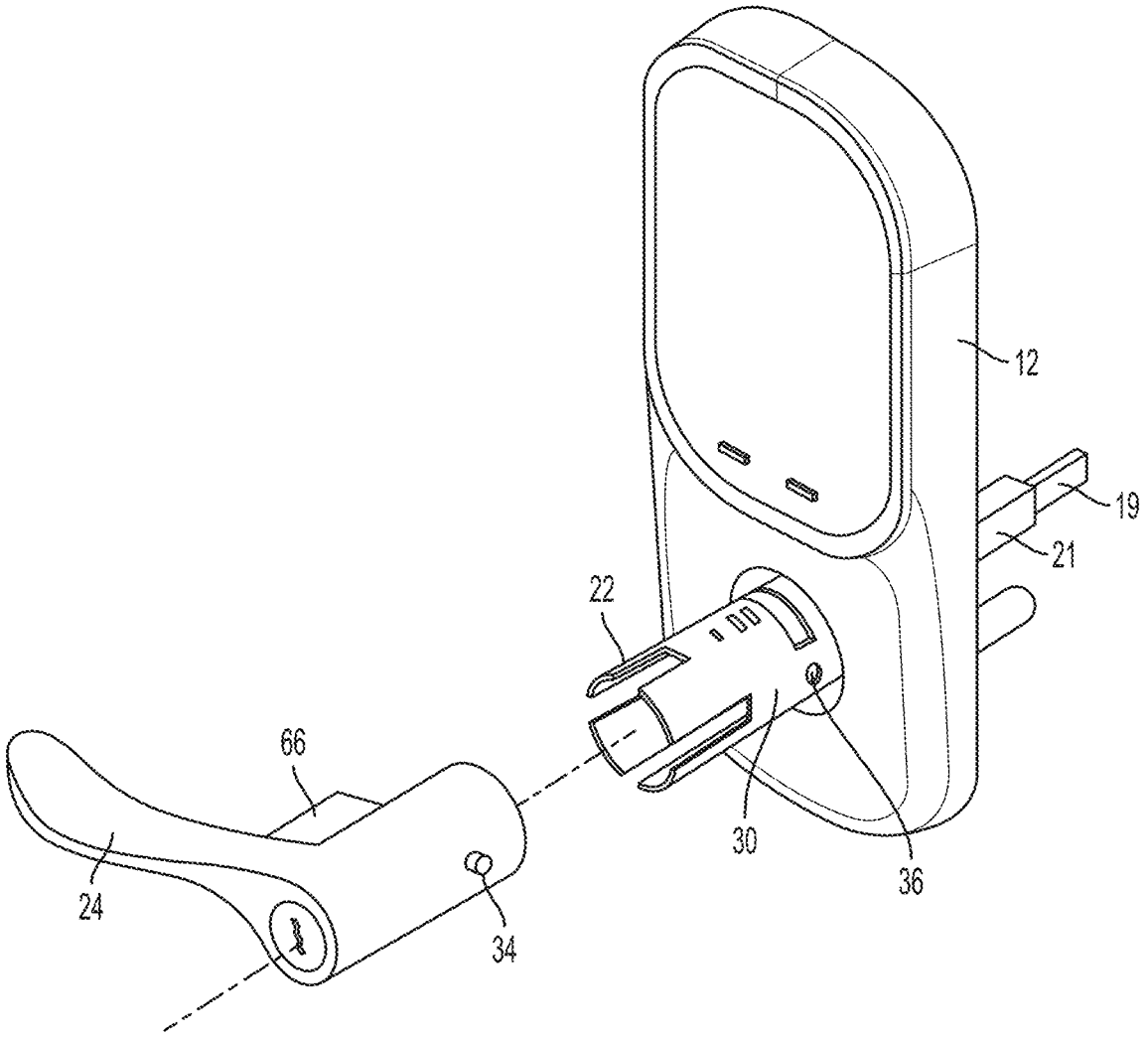
FIG. 2 is a left front perspective exploded view of the door handle assembly in FIG. 1.
Figure 3:
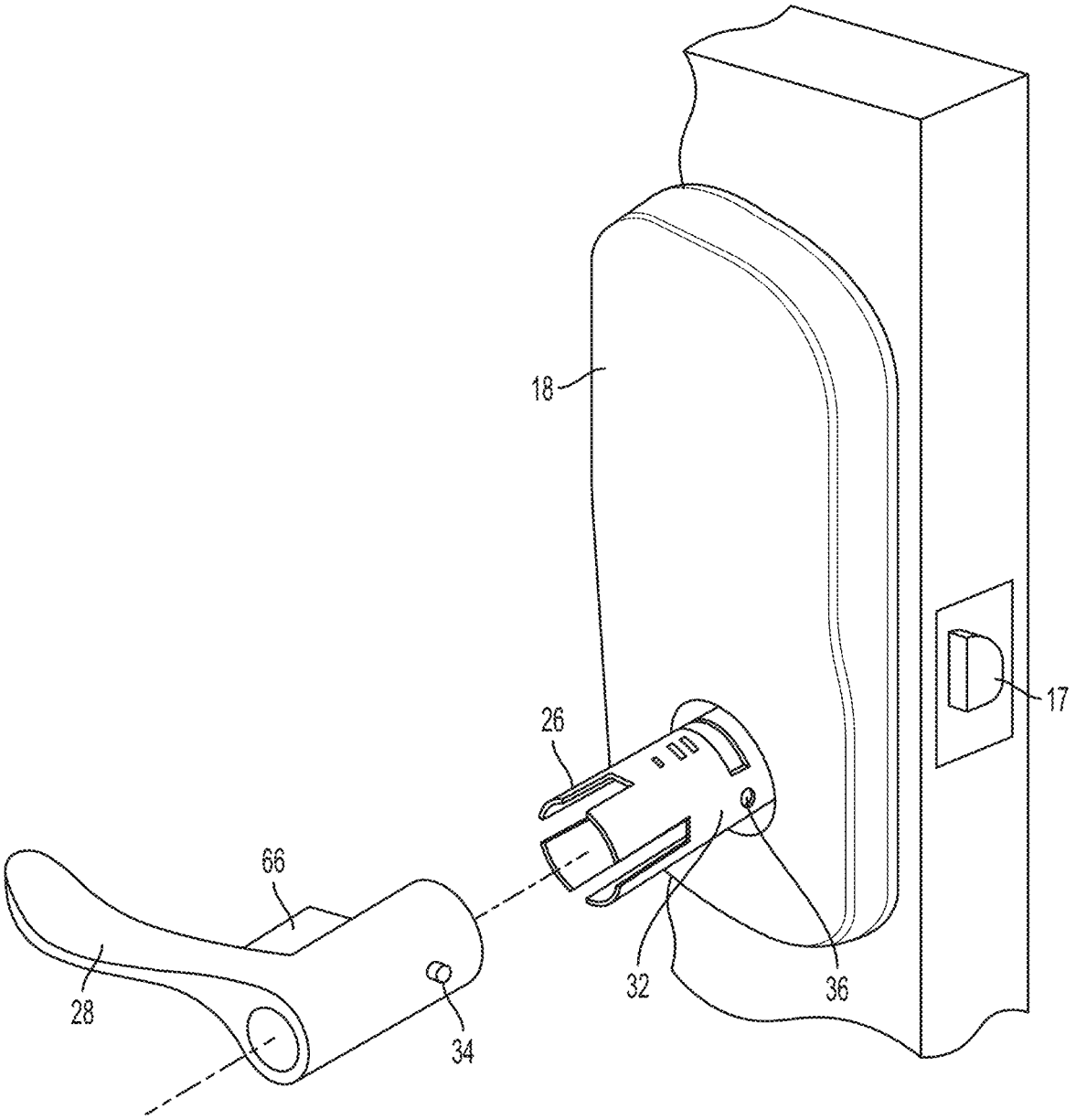
FIG. 3 is a rear perspective exploded view of the door handle assembly of FIG. 1.

Turning now to the figures, according to one embodiment illustrated in FIGS. 1-3, the door handle assembly 10 includes a first body portion 12 for mounting to a first side 14 of a door 16 (e.g., outside) and a second body portion 18 for mounting to a second side 20 of the door 16 (e.g., inside). The first and second body portions are operatively attachable to a latch 17 for retracting the latch to open the door. The first body portion 12 has a first sleeve 22 to which a first handle 24 is releasably coupled. Similarly, the second body portion 18 has a second sleeve 26 to which a second handle 28 is releasably coupled. In this manner, the handles may be configured to be replaced, interchanged and/or swapped. The first sleeve includes a first handle interlock 30 constructed and arranged to releasably couple either one of the first and second handles 24, 28 to the first sleeve, and the second sleeve includes a second handle interlock 32 constructed and arranged to releasably couple either one of the first and second handles to the second sleeve. Thus, the first handle 24 can be selectively positioned on one of the first body portion and the second body portion (e.g., on the first side or the second side of the door), and the second handle can be positioned on the other of the first body portion and the second body portion (e.g., the other of the first side or second side of the door).

According to one embodiment, each of the first handle interlock 30 and the second handle interlock 32 includes one or more spring biased pins 34 that releasably engage within recesses or openings 36 formed in each handle 24, 28. In this manner, the pins are configured to secure the handles to the sleeves. Although spring biased pins are shown and described herein, other suitable handle interlock arrangements may be employed as should be apparent to one of skill in the art. For example, and without limitation, suitable clips, such as spring clips may be used.

Figure 4:
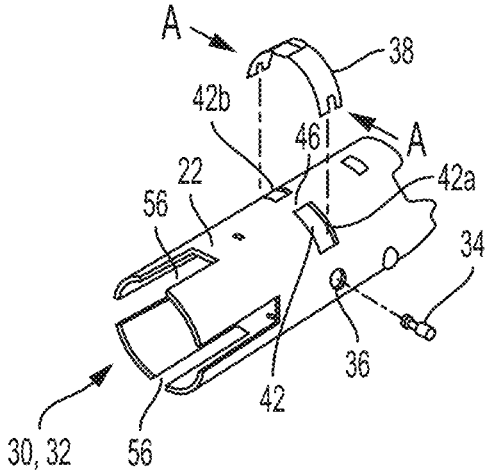
FIG. 4 is a perspective exploded view of a portion of the door handle assembly of FIG. 1.
Figure 5:
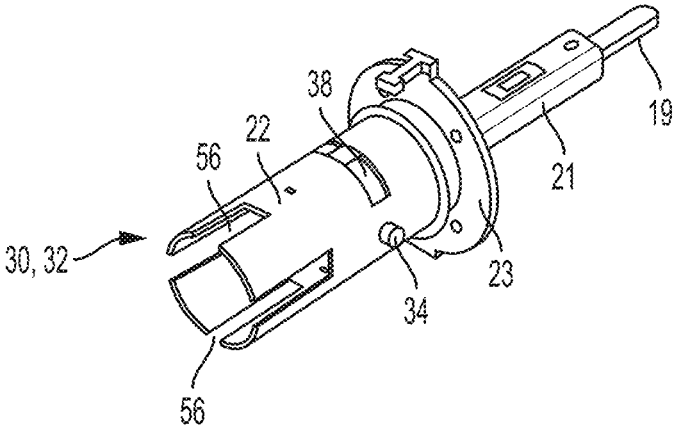
FIG. 5 is a perspective view of a portion of the door handle assembly of FIG. 4.
Figure 6:
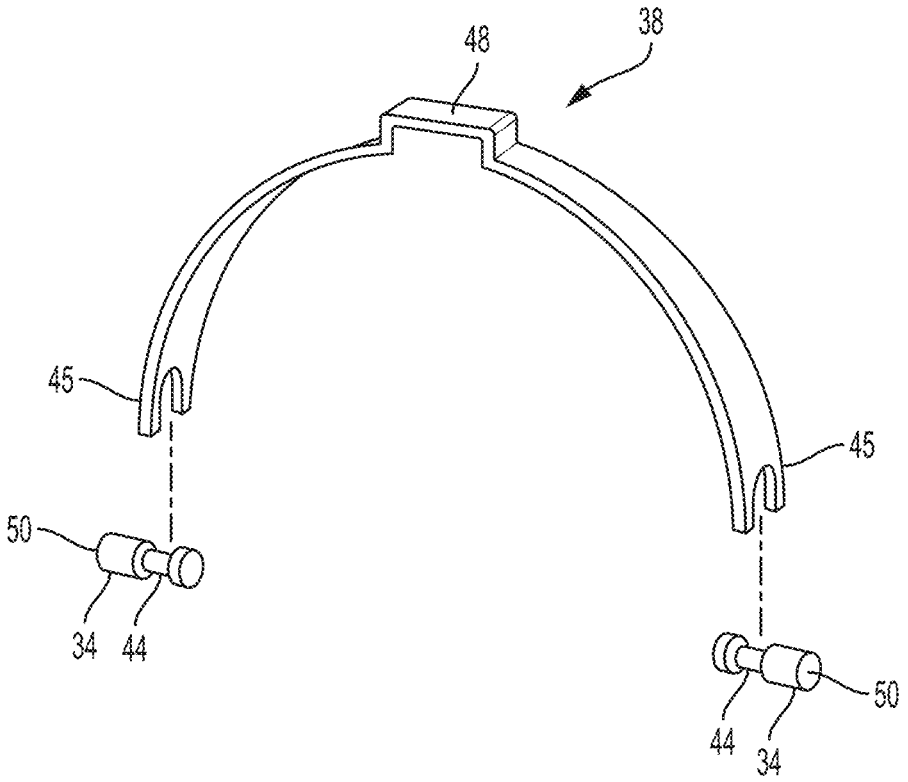
FIG. 6 is a perspective exploded view of a portion of the door handle assembly of FIGS. 4 and 5.

In one embodiment illustrated in FIGS. 4-6, each sleeve 22 includes a pair of oppositely disposed spring pins 34, which may the same size and shape as each other. Springs may be employed to bias the pins in the appropriate direction toward a handle locking position. In one embodiment, a single semicircular leaf spring 38 may be used to oppositely bias the pins in an outward direction relative to the sleeve 22. However, it should be appreciated that other types of resilient elements may be employed to bias the pins as should be apparent to one of skill in the art.

In one embodiment, each sleeve 22 is provided with openings in the form of a round hole along the surface thereof to receive the pins. An additional opening in the form of a slot 42 is located between the holes to receive the semi-circular leaf spring that has a curve that follows the contour of the inside (e.g., inner diameter) of the sleeve. In one embodiment, the first and second openings (holes) 36 are located on opposite sides of the sleeve and generally spaced 180 degrees apart from each other and the third opening (slot) is equidistant between the first and second openings. When the leaf spring engages with the pins, as will be described below, the pins and the spring are held to the sleeve.

The slot 42 may be sized and shaped to removably retain the at least one semicircular leaf spring. The span of the slot 42 may be smaller than the span of the leaf spring and the leaf spring may be flexible and elastically compressible. In this respect, the leaf spring may be compressed inwardly along arrow A-A when inserted into the slot such that when the leaf spring is released after insertion, the outward bias of the leaf spring presses against the inside of the sleeve to hold the spring in place. Accordingly, the leaf spring is retained in the sleeve by compressive force. The leaf spring may be made of any suitable material, such as spring steel, to provide the desired bias. Each end of the leaf spring may include a fork-shaped end 45 that engages a recess 44 in the pin 34, as will be discussed below.

In one embodiment, the slot 42 may be divided into two or more sub-openings 42*a*, 42*b* such that a portion of the sleeve material 46 is disposed between the two openings. This sleeve structure 46 between the two openings may provide support to the leaf spring and/or prevent further inward travel into the slot. In one embodiment, leaf spring may conform to the sleeve. In another embodiment, the leaf spring may have a raised segment 48 that rests on the supporting structure/material 46 between the gaps 42*a*, 42*b*.

The first and second pins 34 are shaped and sized to fit in the first and second holes 36 of the sleeve 22, respectively. In one embodiment, the first and second pins are the same shape and size and are formed from the same material, although other arrangements are contemplated. One end of each pin may have a recess 44 in the form of an annular grove that corresponds to the U-shaped fork end of the semicircular leaf spring. When each pin is inserted into the respective opening, the fork end of the leaf spring engages the annular recess 44 to releasably connect the pin and the leaf spring. Each fork-shaped end 45 may be oriented perpendicular to the surface of a pin, such that the ends of the leaf spring retain the pins. Furthermore, the leaf spring may be compressed within the slot 42, resulting in a radially outward force on the pins. In this configuration, the leaf spring may contact an interior surface 60 of the sleeve, holding the leaf spring and pins in place. Further, each pin is prevented from falling out of the hole because the fork end is prevented from exiting the hole, thus holding the pin within the hole. With the pins held by the leaf spring, the elastic force of the leaf spring may bias the pins in an outward direction opposite the direction of arrow A-A. A distal end 50 of the pin (distal of the recess end) extends beyond the surface of the sleeve in response to the outward force of the leaf spring. Accordingly, the pins may be elastically biased within the respective first and second openings of the sleeve such that the distal end of the pins can be pressed in an inward direction into its corresponding opening by overcoming the outwardly directed spring bias. Allowing the pins to be depressed inwardly facilitates installation and removal of the handles as will be described.

Although the embodiment described includes two openings for the corresponding pins, the present disclosure is not so limited. Accordingly, it is contemplated to employ only one opening with a single pin or more than two openings for additional pins and/or springs.

The handle 24 of the door handle assembly 10 includes a base portion 52 and an actuatable portion 54, used to grip or otherwise manipulate the door handle. The base portion is sized and shaped to fit over the sleeve 22 and the actuatable portion extends laterally from the base portion. In some embodiments, the base portion may have interior features that correspond to exterior features on the sleeve. In one embodiment, the sleeve 22 includes longitudinal slots or grooves 56 to receive corresponding tabs 57 formed on the internal surface of the handle. The tabs engage with the longitudinal slots so that when the handle is actuated, the tabs coact with the corresponding longitudinal groove to rotate the sleeve and thereby retract the latch 17.

The base portion of the handle includes the hole 36 to receive the pin 34. Further, in one embodiment, the inner surface 60 of the base portion 52 near the insertion end 62 of the base portion (the insertion end being the end that is first inserted over the sleeve) includes a ramp 64 such that as the base portion is inserted onto the sleeve, the ramp causes the pins to be depressed inwardly relative to the sleeve. Continued movement of the base portion onto the sleeve then allows the pins to enter and snap out of the hole formed on the base portion once the hole is aligned with the pin. In this manner, the pin is extendable outwardly toward the locking position via the action of the leaf spring as discussed above. Of course, the present disclosure is not limited in this respect and the one or more pins may be manually depressed to allow the base portion to be inserted and held to the sleeve.

Figure 7:
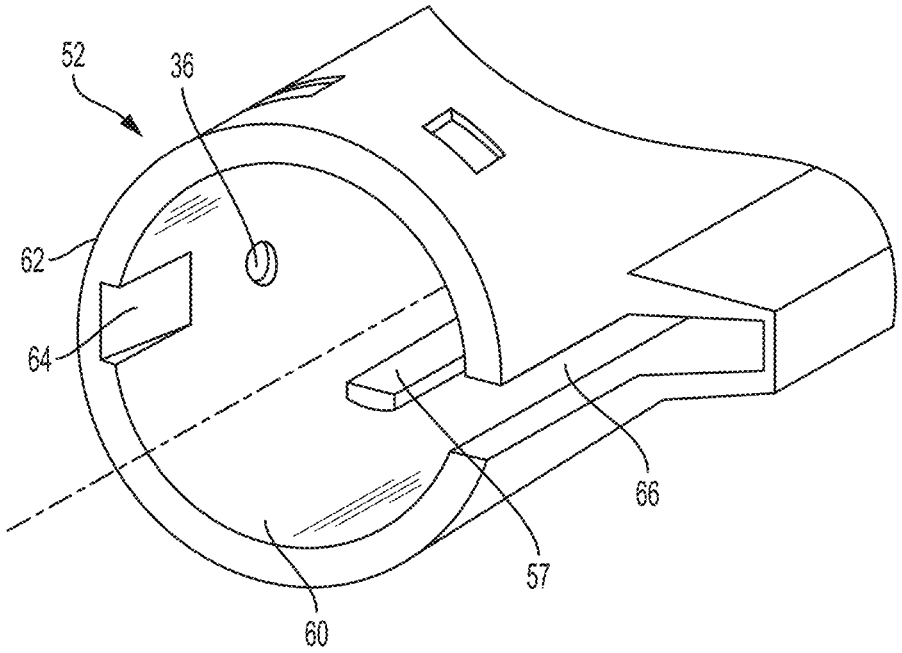
FIG. 7 is a rear perspective view of a portion of a handle according to one embodiment.

In one embodiment illustrated in FIG. 7, an elongated covered slot 66 may be provided opposite the hole 36 in the base portion and extend from the insertion end of the base toward a distal end of the base adjacent the laterally extending actuatable portion. The elongated covered slot receives and extends over the second pin as the handle is inserted onto the sleeve such that the second pin does not engage with the handle.

Although round pins and round holes are disclosed, the present disclosure is not so limited and other shapes of pins may be employed.

To attach a handle, the base portion is placed over the sleeve 22 such that the openings 36 through the base portion and the tabs 57 on the inside surface are radially aligned with the corresponding pins 34 and grooves 56 on the sleeve. The handle base 52 may be moved toward the pins until the ramp 64 at the insertion end of the base portion engages the pin 34. Continued insertion causes the corresponding pin to retract through the action of the ramp 64, allowing the base portion to be fully positioned on the sleeve. Alternatively, the pin may be manually depressed until it is sufficiently below the inner surface of the base to allow continued axial insertion of the base portion onto the sleeve and as the base portion moves over the depressed pin. When the opening 36 overlaps with the depressed pin 34, the elastic force from the resilient element 38 causes the pin 34 to spring into the opening 36. The pin 34 protrudes through the opening 36 and prevents further (axial and radial) movement. To remove the handle, the pin is simply manually depressed until it is sufficiently below the inner surface of the base to allow axial removal of the base portion from the sleeve.

In one embodiment, the actuatable portion 54 of the handle extends perpendicular to the outer circumferential surface of the base 52 in one direction. In some embodiments, the actuatable portion may be asymmetric, e.g., having a curved or irregular shape (as shown) to favor a direction or haptics or just for aesthetic purposes. In other embodiments, the actuatable portion may be symmetric, as the present disclosure is not so limited.

The handle may be removed and reoriented as desired by removing the handle from the sleeve assembly via the handle interlock. In one embodiment, the handles 24, 28 of the first and second body portions are interchangeable such that the first handle 24 shown on the first body portion 12 may be coupled to the second body portion 18 and the second handle 28 shown on the second body portion 18 may be coupled to the first body portion 12.

For a situation where an asymmetric door handle is used, depending on whether the door handle assembly is to be attached to the left side of the door or the right side of the door, the user may select between the first handle 24 or the second handle 28. That is, if the door handle assembly is to be used, for example, on the left side of the door (i.e., the door swings open in a clockwise direction), the user may select to install the first handle 24 with the grip or actuatable portion 54 curving upward on the body portion 12 (outside body portion), as shown in FIG. 1, and install the second handle 28 with the grip portion 54 curving upward on the body portion 18 (inside body portion), as shown in FIG. 3. However, when the door handle assembly is to be used on the right side of the door (i.e., the door swings open in a counter-clockwise direction), the user, still desiring to have the grip portions of the handles curving upward, would install the second handle 28 (not the first handle 24) with the actuatable or grip portion 54 curving upward on the body portion 12 (outside body portion), and install the first handle 24 (not the second handle 28) with the actuatable or grip portion 54 curving upward on the body portion 18 (inside body portion).

The door handle assembly 10 may be used with any door system that uses handles for actuating the latch 17. Depending on the embodiment, the handle can have a direction or orientation, or may be used with omnidirectional handles, such as round knobs. The door handle assembly may be configured and arranged to easily switch the orientation of a handle, or to switch the side location (i.e., side) of the handle relative to the door handle assembly, or to switch the handle with a replacement handle or a handle of a different kind or style.

In one embodiment, the door handle may be configured as a security lock wherein the door handle may be locked to prevent access. In one embodiment, the second end 68 opposite the insertion end 62 of the base may house a lock 70 for a key. In one embodiment, the door handle assembly 10 in addition or exclusively includes an electronic keypad (which may include physical keys or may be a touch screen). The door handle includes battery terminals on the face of the keypad 72. In the embodiment shown, the keypad is an electronic touch screen. In the depicted embodiment, the battery terminals protrude from a face 76 of the keypad above the handle. The terminals are conductive electrodes positioned to allow easy access and interconnection with a 9-volt battery (not shown). In this respect, the terminals of a conventional 9V battery may be placed on the terminals located on the keypad at generally a 90 degree direction relative to the face of the keypad.

The auxiliary battery terminals on the face of the keypad are wired to an electronic circuit (not shown) located within the housing of the door lock. Accordingly, when the terminals of the 9V battery are placed on the electrodes, temporary power may be restored to the lock electronics and the door lock may be actuated to unlock the lock. Specifically, as would be the case when the internal replaceable batteries are powering the electronic circuit, a user can enter an access code via the keypad 72 which then allows the handle 24 to be turned and the latch 17 to be retracted, as is known.

In the embodiment shown in FIG. 5, the sleeve components include a shaft 19, spindle 21, and mounting plate 23. The mounting plate 23 may be a circular disk with a hollow center that is sized to fit the sleeve. The interior circumference of the mounting plate 23 may have features that correspond to features on the first end of the sleeve 22. In one embodiment, the mounting plate 23 attaches to the sleeve 22 by mating the corresponding features and locking them in place by twisting the pieces relative to one another or press-fitting them together. In another embodiment, the mounting plate 23 is retained in the features of the sleeve and the two pieces are screwed together, although other attachment mechanisms are possible.

The shaft 19 and spindle 21 may extend from the lock mechanism of the body and be coaxial with a central axis of the mounting plate 23. The spindle 21 may comprise a polygon-shaped tube that is retained in a hole in a latching assembly. In one embodiment, the tube has a square cross-section. In some embodiments, the shaft may comprise a blade that is retained in a hole in an opposing door latch assembly.

FIG. 2 shows the sleeve components when mounted in the first body portion 12. The first end of the sleeve extends from a front face of the body portion, while spindle 21 and shaft 19 extend from a rear face of the body portion. The sleeve may be turned clockwise or counter-clockwise, which rotates the shaft 19 and the spindle 21 and actuates the latch 17. The rear face of the body portion may abut the exterior surface of a door and be affixed with screws.

Depending on the embodiments, the handle assembly and door components may be formed of metal, plastic, glass, wood, stone, or another rigid material. For example, the door housing may be formed of plastic and metal, while the sleeve and door components may be metal. The components may be machined, or cast or molded.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A door handle assembly for a door having a first side and a second side, the door handle assembly comprising:

a first body portion for mounting to the first side of the door, the first body portion including a first sleeve extending therefrom;

a second body portion for mounting to the second side of the door, the second body portion including a second sleeve extending therefrom;

a first handle configured to be interchangeably coupled to each of the first sleeve and the second sleeve; and a second handle configured to be interchangeably coupled to each of the first sleeve and the second sleeve;

wherein the first sleeve includes a first handle interlock constructed and arranged to releasably couple each of the first handle and the second handle to the first sleeve and the second sleeve includes a second handle interlock constructed and arranged to releasably couple each of the first handle and the second handle to the second sleeve, wherein the first handle is selectively mountable to one of the first sleeve and the second sleeve to be positioned on one of the first side and the second side of the door and the second handle is selectively mountable to the other of the first sleeve and the second sleeve to be positioned on the other of the first side and second side of the door, wherein each of the first handle interlock and the second handle interlock includes a spring, a first spring biased pin operatively mounted to a first end of the spring and a second spring biased pin operatively mounted to a second end of the spring, wherein the spring is arranged to bias each of the first and second spring biased pins, and wherein each of the first and second spring biased pins is releasably coupled to the spring.

2. The door handle assembly of claim 1, wherein each of the first and second spring biased pins is configured to secure the first and second handles on the first and second sleeves.

3. The door handle assembly of claim 2, wherein the first and second spring biased pins are located within each of the first sleeve and the second sleeve.

4. The door handle assembly of claim 3, wherein the spring is a semicircular leaf spring constructed and arranged to bias the first and second spring biased pins toward a handle locking position.

5. A door handle assembly for a door having a first side and a second side, the door handle assembly comprising:

a first body portion for mounting to the first side of the door, the first body portion including a first sleeve extending therefrom;

a second body portion for mounting to the second side of the door, the second body portion including a second sleeve extending therefrom;

a first handle configured to be interchangeably coupled to each of the first sleeve and the second sleeve; and a second handle configured to be interchangeably coupled to each of the first sleeve and the second sleeve;

wherein the first sleeve includes a first handle interlock constructed and arranged to releasably couple each of the first handle and the second handle to the first sleeve and the second sleeve includes a second handle interlock constructed and arranged to releasably couple each of the first handle and the second handle to the second sleeve, wherein the first handle is selectively mountable to one of the first sleeve and the second sleeve to be positioned on one of the first side and the second side of the door and the second handle is selectively mountable to the other of the first sleeve and the second sleeve to be positioned on the other of the first side and second side of the door, wherein each of the first handle interlock and the second handle interlock include spring biased pins configured to secure the first and second handles on the first and second sleeves, wherein the spring biased pins are located within the first sleeve and the second sleeve, wherein each of the first and second handle interlocks includes a semicircular leaf spring constructed and arranged to bias the spring biased pins towards a handle locking position, and wherein each of the spring biased pins includes a recess, the semicircular leaf spring including a fork-shaped end at each end thereof, each fork-shaped end engaging the recess in a corresponding one of the pins.

6. The door handle assembly of claim 5, where the recess has an annular configuration.

7. A handle assembly for a door lock, the handle assembly comprising:

a handle;

a sleeve configured to mount the handle to the door lock, the sleeve including first and second openings extending through an outer surface thereof;

first and second spring biased pins inserted in the first and second openings of the sleeve, a portion of each of the first and second pins extending external to the outer surface of the sleeve when the first and second pins are biased outwardly to a locking position;

a spring releasably coupled to the first and second spring biased pins, the spring arranged to bias each of the first and second spring biased pins, the first spring biased pin operatively mounted to a first end of the spring and the second spring biased pin operatively mounted to a second end of the spring; and the handle including a tubular base and an actuatable portion extending from the base to be manipulated to actuate the door lock, the base configured to be coupled to the sleeve, the base having an opening configured to receive one of the first and second pins to secure the handle to the sleeve.

8. The handle assembly of claim 7, wherein the first and second openings in the sleeve are positioned opposite one another.

9. The handle assembly of claim 8, wherein the first and second openings in the sleeve are positioned 180 degrees apart.

10. The handle assembly of claim 7, wherein the first and second pins have the same size and shape.

11. The handle assembly of claim 7, wherein the tubular base is hollow and configured to fit over the sleeve.

12. The handle assembly of claim 7, wherein the spring is a leaf spring constructed and arranged to bias the first and second pins toward the locking position.

13. The handle assembly of claim 11, wherein the tubular base includes a ramp constructed and arranged to displace at least one of the pins inwardly from the locking position in response to placement of the tubular base over the sleeve.

14. The handle assembly of claim 12, wherein the leaf spring is a semicircular leaf spring.

15. A handle assembly for a door lock, the handle assembly comprising:

a sleeve configured to mount a handle to the door lock, the sleeve including first and second openings extending through an outer surface thereof;

first and second spring biased pins inserted in the first and second openings of the sleeve, a portion of each of the first and second pins extending external to the outer surface of the sleeve when the first and second pins are biased outwardly to a locking position;

the handle including a tubular base and an actuatable portion extending from the base to be manipulated to actuate the door lock, the base configured to be coupled to the sleeve, the base having an opening configured to receive one of the first and second pins to secure the handle to the sleeve; and a leaf spring constructed and arranged to bias the first and second pins toward the locking position, wherein the leaf spring is a semicircular leaf spring, and wherein each of the first and second pins includes a recess, the semicircular leaf spring including a fork-shaped end at each end thereof, each fork-shaped end engaging the recess in a corresponding one of the first and second pins.

16. The handle assembly of claim 15, wherein the recess in each pin has an annular configuration.

17. The handle assembly of claim 1, wherein the spring includes a central portion located on an outer surface of one of the first sleeve and the second sleeve when the first and second spring biased pins are at a handle locking position.

18. The handle assembly of claim 7, wherein the spring includes a central portion located on the outer surface of the sleeve when the first and second spring biased pins are at the handle locking position.

19. A handle assembly for a door lock, the handle assembly comprising:

a sleeve configured to mount a handle to the door lock, the sleeve including a first pair of openings and a second pair of openings extending through an outer surface thereof;

first and second spring biased pins inserted in the first pair of openings of the sleeve, a portion of each of the first and second pins extending external to the outer surface of the sleeve when the first and second pins are biased outwardly to a locking position;

a spring constructed and arranged to bias the first and second spring biased pins toward the handle locking position, the spring comprising:

a central portion extending between the second pair of openings, the central portion located adjacent the outer surface of the sleeve;

a pair of arms extending from the central portion to a respective end of the spring, a portion of the pair of arms extending adjacent an interior surface of the sleeve; and a fork-shaped end at each respective end of the spring, the fork-shaped ends located adjacent the interior surface of the sleeve, the fork-shaped ends releasably engaging the first and second pins.

20. The handle assembly of claim 19, wherein the spring is a semicircular leaf spring.

21. The handle assembly of claim 19, wherein each of the first and second pins includes a recess, each fork-shaped end engaging the recess in a corresponding one of the first and second pins.

22. The handle assembly of claim 19, wherein the first and second pins are releasably coupled to the spring.

* * * * *